US008938885B2

(12) United States Patent
Stevens

(10) Patent No.: US 8,938,885 B2
(45) Date of Patent: Jan. 27, 2015

(54) RAZOR HANDLE WITH A ROTATABLE PORTION

(71) Applicant: The Gillette Company, Boston, MA (US)

(72) Inventor: Christopher John Stevens, Reading (GB)

(73) Assignee: The Gillette Company, Boston, MA (US)

( * ) Notice: Subject to any disclaimer, the term of this patent is extended or adjusted under 35 U.S.C. 154(b) by 222 days.

(21) Appl. No.: 13/747,532

(22) Filed: Jan. 23, 2013

(65) Prior Publication Data

US 2013/0291391 A1 Nov. 7, 2013

Related U.S. Application Data

(60) Provisional application No. 61/640,757, filed on May 1, 2012.

(51) Int. Cl.
*B26B 21/52* (2006.01)
*B26B 21/22* (2006.01)

(52) U.S. Cl.
CPC ..... *B26B 21/52* (2013.01); *B26B 21/225* (2013.01); *B26B 21/521* (2013.01)
USPC ..... 30/527; 30/50; 30/532

(58) Field of Classification Search
CPC ..... B26B 21/52; B26B 21/521
USPC ..... 30/50, 526, 527, 532
See application file for complete search history.

(56) References Cited

U.S. PATENT DOCUMENTS

| | | | |
|---|---|---|---|
| 831,259 | A | 9/1906 | Bingler |
| 1,015,575 | A | 1/1912 | Meyer |
| 1,552,234 | A | 9/1925 | Roebuck |
| 1,639,441 | A | 8/1927 | Spahr |
| 1,693,532 | A | 11/1928 | Stewart |
| 2,083,172 | A | 6/1937 | Smith |
| 2,194,815 | A | 3/1940 | Testi |
| 2,844,870 | A | 7/1958 | Roces et al. |
| 3,935,639 | A | 2/1976 | Terry et al. |
| 3,950,845 | A | 4/1976 | Huntt |

(Continued)

FOREIGN PATENT DOCUMENTS

| | | |
|---|---|---|
| CA | 1045365 | 1/1979 |
| DE | 202004014032 U1 | 1/2005 |

(Continued)

OTHER PUBLICATIONS

PCT International Search Report with Written Opinion in corresponding Int'l appln. PCT/US2013/038774 dated Jul. 15, 2013.

*Primary Examiner* — Hwei C Payer
(74) *Attorney, Agent, or Firm* — Kevin C. Johnson; Steven W. Miller

(57) ABSTRACT

A handle for a shaving razor is described in which the handle comprises a grip portion and a neck portion coupled to an end of the grip portion. The neck portion comprises a frame coupled to the end of the grip portion, the frame comprising a pin; a pod rotatably coupled to the frame, the pod defining an aperture to receive the pin of the frame, wherein the pod is configured to rotate about an axis substantially perpendicular to a length of the grip portion; and a spring coupled to the pod, wherein the spring generates a return torque when the pod is rotated.

14 Claims, 4 Drawing Sheets

(56) References Cited

U.S. PATENT DOCUMENTS

| | | | | |
|---|---|---|---|---|
| 3,964,160 | A | 6/1976 | Gordon | |
| 4,083,103 | A | 4/1978 | Estandian | |
| 4,152,828 | A * | 5/1979 | Lund | 30/529 |
| 4,488,357 | A | 12/1984 | Jacobson | |
| 4,785,534 | A | 11/1988 | Lazarchik | |
| 4,797,998 | A | 1/1989 | Motta | |
| 4,837,930 | A | 6/1989 | Righi | |
| 4,879,811 | A | 11/1989 | Cooney | |
| 4,970,784 | A | 11/1990 | Althaus et al. | |
| 5,029,391 | A | 7/1991 | Althaus et al. | |
| 5,033,152 | A | 7/1991 | Althaus | |
| 5,038,472 | A | 8/1991 | Iderosa | |
| 5,084,969 | A | 2/1992 | Althaus | |
| 5,093,991 | A | 3/1992 | Hendrickson | |
| 5,222,300 | A | 6/1993 | Althaus et al. | |
| 5,224,267 | A | 7/1993 | Simms et al. | |
| 5,313,706 | A | 5/1994 | Motta et al. | |
| 5,416,974 | A | 5/1995 | Wain | |
| 5,526,568 | A | 6/1996 | Copelan | |
| 5,535,518 | A | 7/1996 | Althaus | |
| 5,560,106 | A | 10/1996 | Armbruster et al. | |
| 5,579,580 | A | 12/1996 | Althaus et al. | |
| 5,678,316 | A | 10/1997 | Althaus et al. | |
| 5,771,591 | A | 6/1998 | Armbruster et al. | |
| 5,787,593 | A | 8/1998 | Althaus | |
| 5,813,293 | A | 9/1998 | Apprille, Jr. et al. | |
| 5,822,869 | A | 10/1998 | Metcalf et al. | |
| 5,865,189 | A | 2/1999 | Andrews | |
| 5,953,824 | A | 9/1999 | Ferraro et al. | |
| 5,953,825 | A | 9/1999 | Christman et al. | |
| 6,115,924 | A | 9/2000 | Oldroyd | |
| 6,182,366 | B1 | 2/2001 | Richard | |
| 6,247,234 | B1 | 6/2001 | Hill et al. | |
| 6,301,786 | B1 | 10/2001 | Oswald et al. | |
| 6,311,400 | B1 | 11/2001 | Hawes et al. | |
| 6,357,117 | B1 | 3/2002 | Eichhorn et al. | |
| 6,381,857 | B1 | 5/2002 | Oldroyd | |
| 6,615,498 | B1 | 9/2003 | King et al. | |
| 6,675,480 | B2 | 1/2004 | Oswald | |
| 6,688,002 | B2 | 2/2004 | Momose et al. | |
| 6,880,253 | B1 | 4/2005 | Gyllerstrom | |
| 6,935,029 | B2 | 8/2005 | Morisugi et al. | |
| 7,017,270 | B2 | 3/2006 | Shiba et al. | |
| 7,020,966 | B2 | 4/2006 | Shiba et al. | |
| 7,127,818 | B2 | 10/2006 | Sato et al. | |
| 7,137,205 | B2 | 11/2006 | Royle | |
| 7,140,116 | B2 | 11/2006 | Coffin | |
| 7,162,801 | B2 | 1/2007 | Royle | |
| 7,168,173 | B2 | 1/2007 | Worrick, III | |
| 7,185,436 | B2 | 3/2007 | Murphy et al. | |
| 7,200,938 | B2 | 4/2007 | Lembke | |
| 7,461,456 | B2 | 12/2008 | Tsushio et al. | |
| 7,503,117 | B2 | 3/2009 | Wetzel et al. | |
| 7,685,720 | B2 | 3/2010 | Efthimiadis et al. | |
| 7,690,122 | B2 | 4/2010 | Worrick, III et al. | |
| 7,877,879 | B2 | 2/2011 | Nakasuka | |
| 7,895,754 | B2 | 3/2011 | Blackburn | |
| 7,913,393 | B2 | 3/2011 | Royle et al. | |
| 7,937,837 | B2 | 5/2011 | Psimadas et al. | |
| 7,971,363 | B2 | 7/2011 | Nakasuka | |
| 8,024,863 | B2 | 9/2011 | Wain | |
| 8,033,022 | B2 | 10/2011 | Ben-Ari | |
| 8,033,023 | B2 | 10/2011 | Johnson et al. | |
| 8,061,041 | B2 | 11/2011 | Jessemey et al. | |
| 8,065,802 | B2 | 11/2011 | Oglesby et al. | |
| 8,079,147 | B2 | 12/2011 | Wonderley | |
| 8,151,466 | B2 | 4/2012 | Putzer | |
| 8,151,472 | B2 | 4/2012 | Dimitris et al. | |
| 8,166,658 | B2 | 5/2012 | Nakasuka | |
| 8,166,661 | B2 | 5/2012 | King | |
| 8,205,343 | B2 * | 6/2012 | Winter et al. | 30/527 |
| 8,205,344 | B2 | 6/2012 | Stevens | |
| 8,234,789 | B2 | 8/2012 | Avens et al. | |
| 8,261,451 | B2 | 9/2012 | Macove | |
| 8,286,354 | B2 | 10/2012 | Walker, Jr. et al. | |
| 8,323,562 | B2 | 12/2012 | Schorr et al. | |
| 8,474,144 | B2 * | 7/2013 | Royle | 30/532 |
| 8,745,882 | B2 * | 6/2014 | Murgida et al. | 30/527 |
| 2002/0104223 | A1 | 8/2002 | Oldroyd | |
| 2005/0000100 | A1 | 1/2005 | Coffin | |
| 2005/0198839 | A1 | 9/2005 | Walker | |
| 2006/0162167 | A1 | 7/2006 | Walker | |
| 2006/0277769 | A1 | 12/2006 | Coffin et al. | |
| 2007/0193042 | A1 * | 8/2007 | Worrick et al. | 30/527 |
| 2008/0022530 | A1 | 1/2008 | Royle | |
| 2008/0034591 | A1 | 2/2008 | Fung | |
| 2008/0196251 | A1 | 8/2008 | Royle | |
| 2008/0256800 | A1 | 10/2008 | Nicoll | |
| 2009/0066218 | A1 | 3/2009 | Fan | |
| 2009/0313837 | A1 | 12/2009 | Winter et al. | |
| 2010/0043242 | A1 | 2/2010 | Stevens | |
| 2010/0083505 | A1 | 4/2010 | Royle et al. | |
| 2010/0132204 | A1 * | 6/2010 | Brown | 30/527 |
| 2010/0154221 | A1 | 6/2010 | De Benedetto et al. | |
| 2010/0313426 | A1 | 12/2010 | Royle | |
| 2011/0010943 | A1 | 1/2011 | Izumi | |
| 2011/0023305 | A1 | 2/2011 | Whelan et al. | |
| 2011/0035950 | A1 * | 2/2011 | Royle | 30/532 |
| 2011/0067245 | A1 | 3/2011 | Bridges et al. | |
| 2011/0088268 | A1 | 4/2011 | Marut | |
| 2011/0138637 | A1 | 6/2011 | Bucco | |
| 2011/0146080 | A1 | 6/2011 | Pauw | |
| 2011/0167641 | A1 | 7/2011 | Brada et al. | |
| 2011/0167653 | A1 | 7/2011 | Psimadas et al. | |
| 2011/0173821 | A1 | 7/2011 | Hage et al. | |
| 2011/0225826 | A1 | 9/2011 | Leventhal | |
| 2011/0239475 | A1 | 10/2011 | Efthimiadis et al. | |
| 2011/0247217 | A1 | 10/2011 | Johnson et al. | |
| 2011/0277326 | A1 | 11/2011 | Bodet | |
| 2011/0308089 | A1 | 12/2011 | Bridges | |
| 2012/0047754 | A1 | 3/2012 | Schmitt | |
| 2012/0060382 | A1 | 3/2012 | Beugels et al. | |
| 2012/0073149 | A1 | 3/2012 | Murgida et al. | |
| 2012/0073150 | A1 | 3/2012 | Murgida et al. | |
| 2012/0084984 | A1 | 4/2012 | Davis | |
| 2012/0096718 | A1 | 4/2012 | Howell et al. | |
| 2012/0096722 | A1 | 4/2012 | Howell et al. | |
| 2012/0096723 | A1 | 4/2012 | Howell et al. | |
| 2012/0124840 | A1 | 5/2012 | Iaccarino et al. | |
| 2012/0198698 | A1 | 8/2012 | Szczepanowski et al. | |
| 2012/0233868 | A1 | 9/2012 | Bridges et al. | |
| 2012/0255185 | A1 | 10/2012 | Patel et al. | |
| 2012/0260509 | A1 | 10/2012 | Fang et al. | |
| 2012/0291295 | A1 | 11/2012 | Braun | |
| 2012/0297625 | A1 | 11/2012 | Madden | |
| 2013/0291391 | A1 * | 11/2013 | Stevens | 30/530 |

FOREIGN PATENT DOCUMENTS

| | | | |
|---|---|---|---|
| EP | 0 885 697 | A1 | 12/1998 |
| FR | 2639280 | A1 | 5/1990 |
| FR | 2706142 | A1 | 12/1994 |
| GB | 2 116 470 | A | 9/1983 |
| GB | 2 393 679 | A | 4/2004 |
| GB | 2 458 316 | A | 9/2009 |
| JP | 02-034193 | | 2/1990 |
| JP | 02-052694 | | 2/1990 |
| JP | 04-022388 | | 1/1992 |
| JP | 4269992 | A | 9/1992 |
| JP | 9225159 | A | 9/1997 |
| JP | 200300871 | A | 10/2000 |
| JP | 2001046761 | A | 2/2001 |
| WO | WO 89/10245 | | 11/1989 |
| WO | WO 2006/027018 | A1 | 3/2006 |
| WO | WO 2006/108115 | A1 | 10/2006 |
| WO | WO 2011/094887 | A1 | 8/2011 |
| WO | WO 2012/157624 | A1 | 11/2012 |
| WO | WO 2012/158143 | A1 | 11/2012 |
| WO | WO 2012/161449 | A2 | 11/2012 |

* cited by examiner

RAZOR HANDLE WITH A ROTATABLE PORTION

FIELD OF THE INVENTION

The invention generally relates to handles for razors, more particularly to handles with a rotatable portion such that a safety razor blade unit including at least one blade with a sharp cutting edge is mounted on the handle to be movable pivotally relative to the handle under forces exerted on the blade unit in the course of shaving. Such a blade unit of the safety razor can pivot about more than one axis of rotation. A blade unit may have a plurality of blades, for example two, three, four or more blades, with straight parallel cutting edges disposed for contact with the skin between guard and cap surfaces also provided on the blade unit. The guard may include a strip of elastomeric material with a surface configuration, for example upstanding projections such as in the shape of fins, to produce a desired interaction with the skin as the blade unit is moved across the skin in the performance of a shaving stroke. The cap surface may include a strip of material containing a shaving enhancement product, such as a lubricant, which can gradually leach out of the strip material for application to the skin during shaving. The safety razor blade unit may be mounted detachably on the razor handle to allow the blade unit to be replaced by a fresh blade unit when the blade sharpness has diminished to an unsatisfactory level. Alternatively, the blade unit can be connected permanently to the handle with the intention that the entire razor should be discarded when the blade or blades have become dulled. Detachable and replaceable blade units are commonly referred to as shaving cartridges.

BACKGROUND OF THE INVENTION

Recent advances in shaving razors, such as a 5-bladed or 6-bladed razor for wet shaving, may provide for closer, finer, and more comfortable shaving. One factor that may affect the closeness of the shave is the amount of contact for blades on a shaving surface. The larger the surface area that the blades contact then the closer the shave becomes. Current approaches to shaving largely comprise of razors with only a single axis of rotation, for example, about an axis substantially parallel to the blades and substantially perpendicular to the handle (i.e., front-and-back pivoting motion). The curvature of various shaving areas, however, does not simply conform to a single axis of rotation and, thus, a portion of the blades often disengage from the skin during shaving as they have limited ability to pivot about the single axis. Therefore, blades on such razors may only have limited surface contact with certain shaving areas, such as under the chin, around the jaw line, around the mouth, etc.

Razors with multiple axes of rotation may help in addressing closeness of shaving and in more closely following skin contours of a user. For example, a second axis of rotation for a razor can be an axis substantially perpendicular to the blades and substantially perpendicular to the handle, such as side-to-side pivoting motion. Examples of various approaches to shaving razors with multiple axes of rotation are described in U.S. Pat. Nos. 5,029,391; 5,093,991; 5,526,568; 5,560,106; 5,787,593; 5,953,824; 6,115,924; 6,381,857; 6,615,498; 6,880,253; and 7,913,393; U.S. Patent Application Publication Nos. 2009/066218; 2009/0313837; and 2010/0043242; and Japanese Patent Laid Open Publication Nos. H2-34193; H2-52694; and H4-22388. However, to provide another axis of rotation, such as an axis substantially perpendicular to the blades and substantially perpendicular to the handle; typically, additional parts are implemented with increased complexity and movement, but durability, performance, and efficiency may suffer over time. As a result, current approaches introduce complexities and durability issues for manufacturing, assembling, and using razors with multiple axes of rotation.

What is needed, then, is a razor, suitable for wet or dry shaving, with multiple axes of rotation, for example, an axis substantially perpendicular to the blades and substantially perpendicular to the handle and an axis substantially parallel to the blades and substantially perpendicular to the handle. The razor, including powered and manual razors, is preferably simpler, cost-effective, reliable, and durable.

SUMMARY OF THE INVENTION

In one aspect, the invention relates to a handle for a shaving razor. The handle comprises a grip portion and a neck portion coupled to an end of the grip portion. The neck portion comprises a frame coupled to the end of the grip portion, the frame comprising a pin; a pod rotatably coupled to the frame, the pod defining an aperture to receive the pin of the frame, wherein the pod is configured to rotate about an axis substantially perpendicular to a length of the grip portion; and a spring coupled to the pod, wherein the spring generates a return torque when the pod is rotated.

This aspect can include any one or more of the following features. The neck portion can further comprise an anchor coupled to the end of the grip portion and to the spring. The anchor can be made from metal, optionally, brass. The spring can be a tension spring. The pin can be made from metal, optionally, stainless steel. The spring can be adjustable to vary the spring force and the return torque. The neck portion can be configured to releasably engage a razor cartridge. The neck portion can further comprise a razor cartridge releasing assembly. The pod can define a recess to receive the razor cartridge releasing assembly. The pin of the frame can fall along the axis. The pod can be unitary and formed from molded plastic. The pod can rotate about 10 degrees to about 20 degrees from an at rest position, preferably about 15 degrees from the at rest position.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Except as otherwise noted, the articles "a," "an," and "the" mean "one or more."

Figure 1:
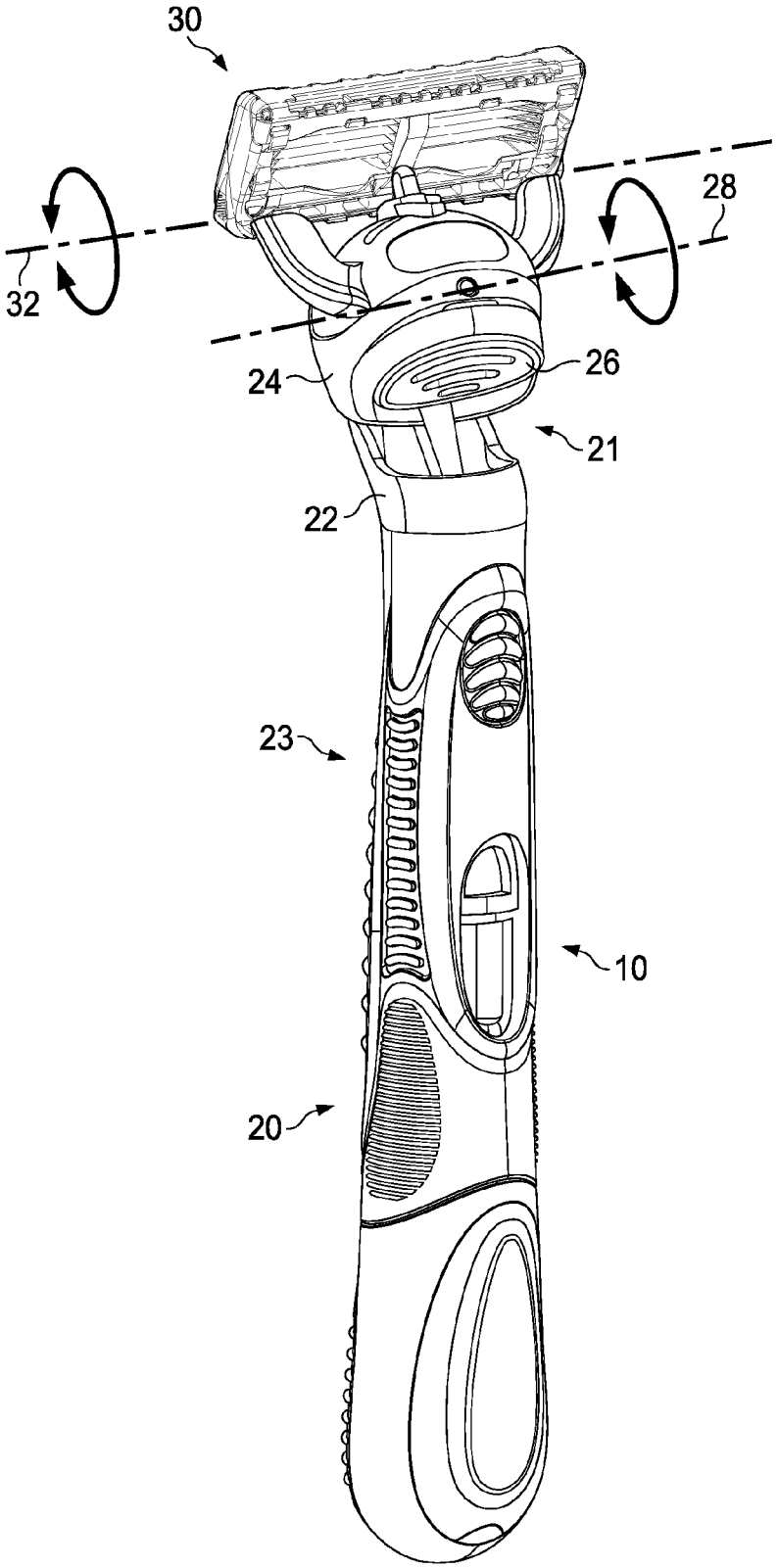
FIG. 1 is a schematic perspective view of a shaving razor in accordance with an embodiment of the invention.

Referring to FIG. 1, a shaving razor 10 of the present invention comprises a handle 20 and a blade cartridge unit 30, which may releasably attach or be permanently attached to the handle 20 and contains one or more blades. The handle 20 comprises a neck portion 21 and a grip portion 23. The grip portion 23 comprises a frame 22, a pod 24, and a razor cartridge releasing assembly 26. The pod 24 is operably coupled to the frame 22 such that the pod 24 is configured to rotate about an axis of rotation 28 that is substantially perpendicular to the blades and substantially perpendicular to a length of the handle 20. The blade cartridge unit 30 is configured to rotate about an axis of rotation 32 that is substantially parallel to the blades and substantially perpendicular to the length of the handle 20. Nonlimiting examples of suitable blade cartridge units are described in U.S. Pat. No. 7,168,173. When the blade cartridge unit 30 is attached to the handle 20, the blade cartridge unit 30 is configured to rotate about multiple axes of rotation, for example, a first axis of rotation 28 and a second axis of rotation 32.

Figure 2:
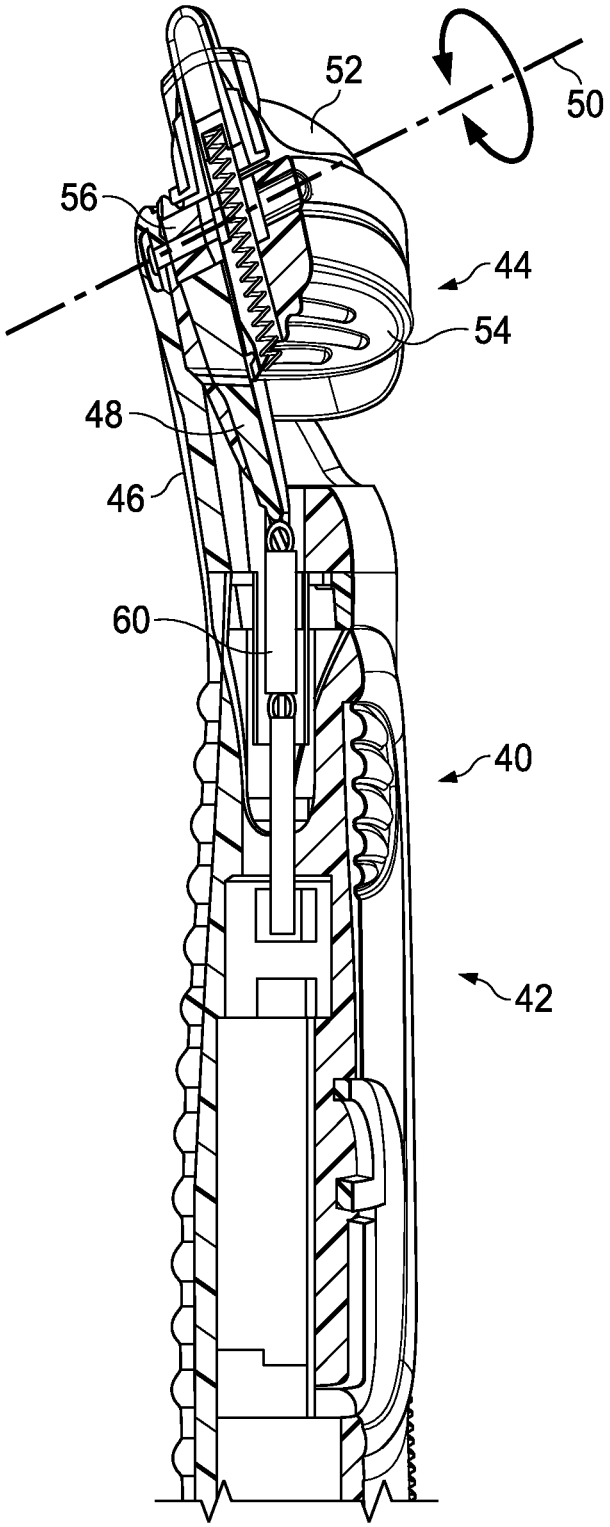
FIG. 2 is a schematic perspective view of a partial cross section of a handle of a shaving razor according to an embodiment of the invention.
Figure 3:
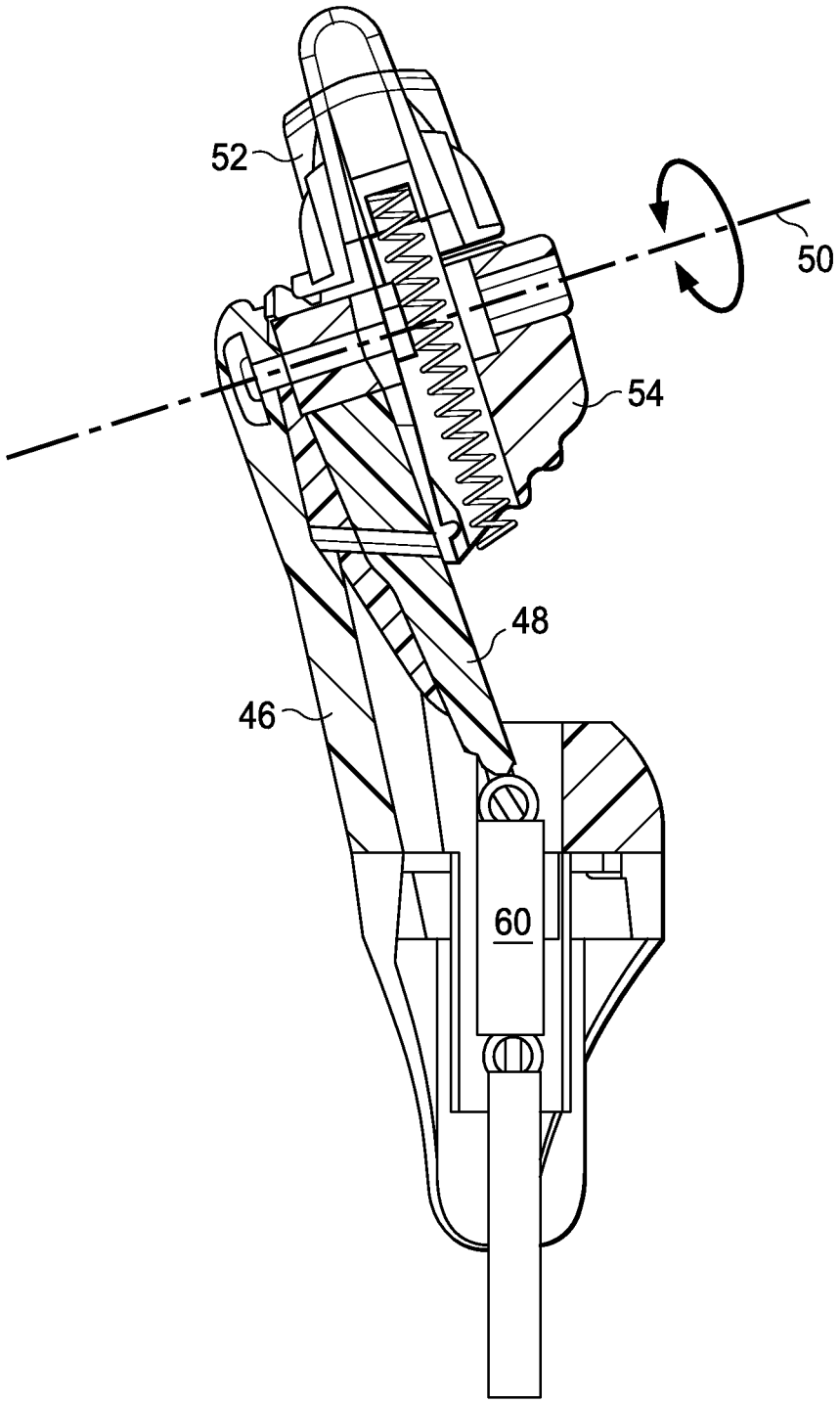
FIG. 3 is a partial schematic side view of the partial cross section of the handle of FIG. 2.
Figure 4:
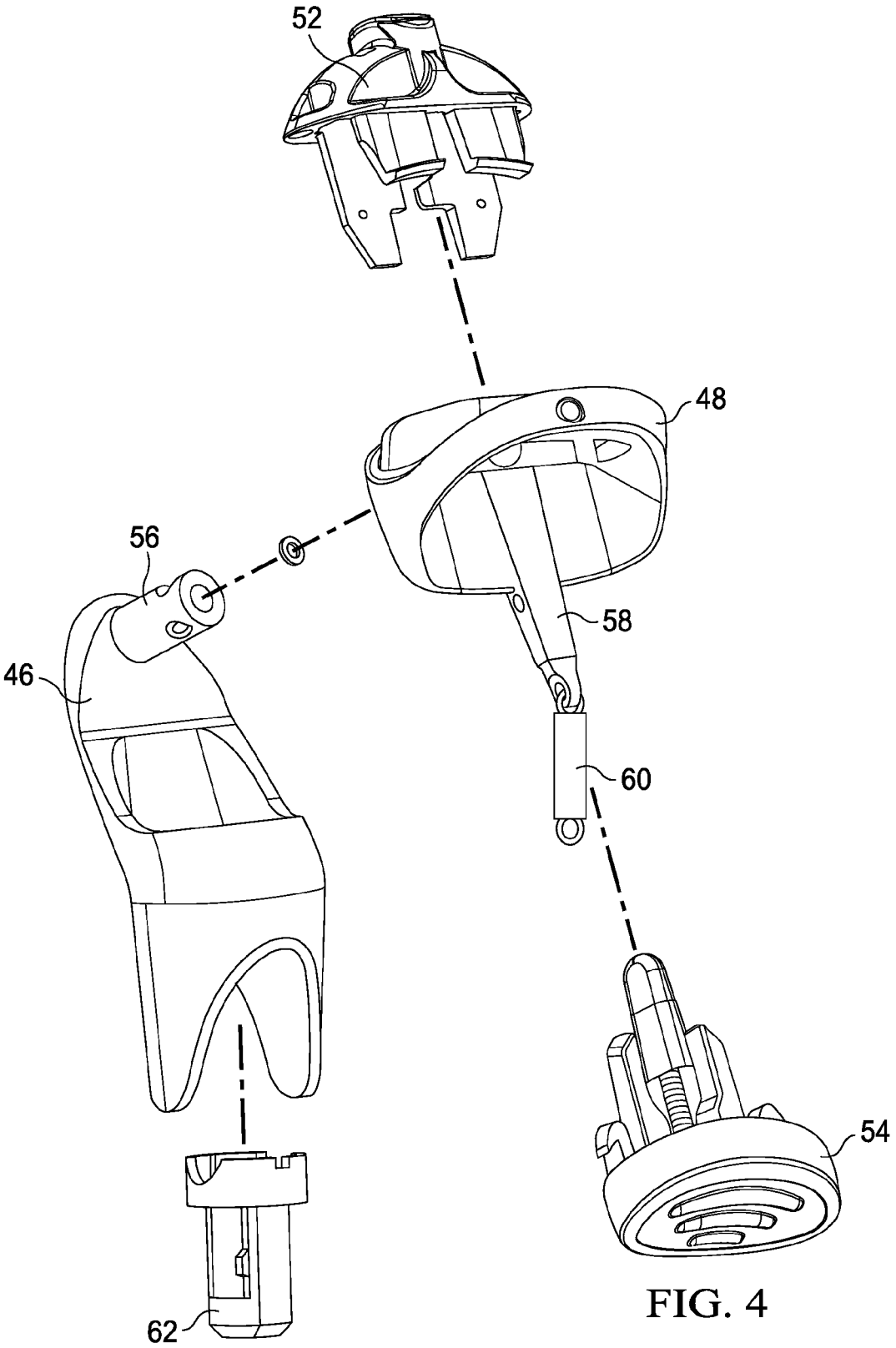
FIG. 4 is a schematic exploded perspective view of the handle of FIG. 3.

FIGS. 2-4 depict an embodiment of a handle 40 of the present invention. The handle 40 comprises a grip portion 42 and a neck portion 44. The neck portion 44 comprises a frame 46 and a pod 48 operably coupled thereto such that the pod 48 is configured to rotate about an axis of rotation 50 that is substantially perpendicular to a length of the handle 40. Coupled to the pod 48 and the frame 46 includes a docking station 52 engageable with a blade cartridge unit (not shown) and an ejector button assembly 54 for releasing a blade cartridge unit from the handle 40. Nonlimiting examples of suitable docking stations and ejector button assemblies are described in U.S. Pat. Nos. 7,168,173 and 7,690,122 and U.S. Patent Application Publication Nos. 2005/0198839, 2006/0162167, and 2007/0193042. In an embodiment, the docking station 52 and the ejector button assembly 54 are coupled to one another within a cavity of the pod 48.

The frame 46 is coupled to a grip portion 42 of the handle 40 so as to provide a fixed reference for the pod 48. The frame 46 can be received within the grip portion 42 by a snap fit, interference fit, screw thread connection, etc. A pin 56 of the frame 46 couples the pod 48 to the frame 46. In an embodiment, the pin 56 is a component releasably attached to the frame 46, e.g., via snap fit, interference fit, screw thread connection, etc. Alternatively, the pin 56 is integrally formed with the frame 46 such that the pod 48 can define apertures defined to receive the pin 56 via snap fit or interference fit. The apertures of the pod 48 correspond in shape and are configured to mate with portions of the pin 56. In an embodiment, the pin 56 does not have a uniform shape. By way of example, the pin 56 may be generally cylindrical with one portion being of a larger cylindrical portion than another, smaller cylindrical portion. In such an example, the apertures of the pod 48 are similarly proportioned—with one aperture having a larger size than the other aperture—to receive the pin 56. The pod 44 may, optionally, include a tail portion 58 extending therefrom. The tail portion 58 may be coupled to a spring 60 in which the spring 60 is coupled to an anchor 62. The anchor 62 may be received within the grip portion 42 to anchor the tail portion 58 of the pod 48 within a cavity of the grip portion 42.

In an embodiment, the pin 56 of the frame 46 lies along an axis of rotation 50 about which the pod 48 rotates. The spring 60 is attached to the tail portion 58 of the pod 48 in which rotation of the pod 48 from an at rest portion puts the spring 60 into tension—e.g., into further tension as the spring 60 may optionally be in tension when at rest—so that the spring 60 provides a torque to return the pod 48 to the at rest position. Additionally or alternatively, the spring 60 is adjustable to vary the spring force and the return torques. In an embodiment, the spring 60 is a tension spring or a coiled spring. An embodiment to adjust the spring 60 is to lengthen the spring 60 in the at rest position, e.g., a neutral position, preferably a neutral, preloaded position, when coupled to the tail portion 58, by deepening the anchor 62 within the grip position 42, to which the spring 60 is attached. The pod 48 is configured to rotate about 10 degrees to about 20 degrees from the at rest position, preferably about 15 degrees. In an embodiment, the pod 48 is unitary such that the tail portion 58 is integrally formed with the rest of the pod 48.

In an embodiment, at least a portion of the frame 46, pod 48, and anchor 62 are made from hard plastic, such as Zylar®. Additionally or alternatively, one or more of the frame 46, pod 48, and anchor 62 are made from the same material. In an embodiment, the pin 56 of the frame 46 is made from hard plastic or metal (e.g., stainless steel). In an embodiment, the spring 60 is also made from plastic, such as hard plastic. Alternatively, the spring 60 is made from metal.

A further advantage of the present invention is that the strength of the return forces can easily be modified by using various spring elements, in which the spring elements are optionally adjustable.

For razors embodying the present invention the return force characteristic increases smoothly to a maximum with the effective spring rate of the return force characteristic gradually increasing as the pivot angle increases from the respective rest position. Furthermore, during the return pivotal movement the return force characteristic curve closely follows that relating to the pivotal movement in the opposite direction so that the return force is always consistent for a given pivotal displacement and smooth pivotal motion is achieved, such as if the blade unit undergoes reversals of pivoting direction in the execution of a shaving stroke.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A handle for a shaving razor, the handle comprising:

a grip portion; and a neck portion coupled to an end of the grip portion, the neck portion comprising:

a frame coupled to the end of the grip portion, the frame comprising a pin;

a pod rotatably coupled to the frame, the pod defining an aperture to receive the pin of the frame, wherein the pod is configured to rotate about an axis substantially perpendicular to a length of the grip portion;

a spring having two ends with one end coupled to the pod, wherein the spring generates a return torque when the pod is rotated, and an anchor having a first end and a second end, and wherein the first end is coupled to the end of the grip portion and the second end is coupled to the other end of the spring.

2. The handle of claim 1, wherein the anchor is made from metal.

3. The handle of claim 2, wherein the metal is brass.

4. The handle of claim 1, wherein the spring is a tension spring.

5. The handle of claim 1, wherein the pin is made from metal.

6. The handle of claim 5, wherein the metal is stainless steel.

7. The handle of claim 1, wherein the spring is adjustable to vary the spring force and the return torque.

8. The handle of claim 1, wherein the neck portion is configured to releasably engage a razor cartridge.

9. The handle of claim 8, wherein the neck portion further comprises a razor cartridge releasing assembly.

10. The handle of claim 9, wherein the pod defines a recess to receive the razor cartridge releasing assembly.

11. The handle of claim 1, wherein the pin of the frame falls along the axis.

12. The handle of claim 1, wherein the pod is unitary and formed from molded plastic.

13. The handle of claim 1, wherein the pod rotates about 10 degrees to about 20 degrees from an at rest position.

14. The handle of claim 13, wherein the pod rotates about 15 degrees from the at rest position.

* * * * *